US005794799A

United States Patent [19]

Collins et al.

[11] Patent Number: 5,794,799

[45] Date of Patent: Aug. 18, 1998

[54] CURLING IRON ORGANIZER WITH TEMPERATURE DISPLAY

[76] Inventors: Joyce E. Collins, 7071 Melanie Dr.; Ethel Evans, 2485 W. Belmont St., both of Pensacola, Fla. 32505

[21] Appl. No.: 719,361

[22] Filed: Sep. 25, 1996

[51] Int. Cl.[6] ..... A47F 7/00

[52] U.S. Cl. ..... 211/70.6; 219/242; 248/117.2; 211/60.1

[58] Field of Search ..... 211/70.6, 60.1, 211/26; 248/309, 117.1, 117.2, 117.6, 117.7; 312/209, 223.1, 223.5, 223.6, 242; 219/242, 225, 521

[56] References Cited

U.S. PATENT DOCUMENTS

| | | | |
|---|---|---|---|
| 2,514,400 | 7/1950 | Larkins | 248/117.7 X |
| 4,354,093 | 10/1982 | Zago | 219/242 X |
| 4,418,268 | 11/1983 | Munshaw | 248/117.2 X |
| 4,446,972 | 5/1984 | Sussman | 211/13 |
| 4,871,074 | 10/1989 | Bryson et al. | 211/13 |
| 5,025,935 | 6/1991 | Hadachek | 211/60.1 X |
| 5,048,742 | 9/1991 | Fortune | 219/242 X |
| 5,054,615 | 10/1991 | Stillwagon et al. | 206/373 |
| 5,090,649 | 2/1992 | Tipp | 219/242 X |
| 5,124,532 | 6/1992 | Hafey et al. | 219/242 |
| 5,141,189 | 8/1992 | Andrew | 248/154 |
| 5,203,456 | 4/1993 | Boswell | 248/117.6 X |
| 5,547,393 | 8/1996 | Jansen | 219/242 X |
| 5,577,918 | 11/1996 | Olsen | 312/242 |
| 5,615,782 | 4/1997 | Choe | 211/70.6 |

*Primary Examiner*—Peter M. Cuomo
*Assistant Examiner*—Robert J Sandy
*Attorney, Agent, or Firm*—Joseph N. Breaux

[57] ABSTRACT

A curling iron organizer comprising a housing having a plurality of curling iron holding cavities, each sized to receive the handle end of a curling iron at least partially therein; a power distribution circuit including a like plurality of power outlets; a like plurality of curling iron supports, each curling iron support including a tip receiving member constructed of a heat conducting material such as metal positioned with respect to one of said plurality of curling iron holding cavities in a manner such that the heated tip end of a curling iron is cradled within the tip receiving member when the handle of the curling iron is positioned within the respective curling iron holding cavity; a plurality of temperature display devices, at least one of said plurality of temperature display devices being mounted to a back surface of each of the tip receiving members; and a reflecting device attached to the housing and positioned with respect to the plurality of temperature display devices in a manner such that the reflection of each temperature display device can be viewed by a user.

20 Claims, 2 Drawing Sheets

CURLING IRON ORGANIZER WITH TEMPERATURE DISPLAY

TECHNICAL FIELD

The present invention relates to devices for organizing a number of tools for performing a task and more particularly to an organizer for organizing a number of curling irons used for curling hair that includes a power outlet for each of the curling irons, a curling iron support for each curling iron, a temperature display mounted to a back surface of each of the tip retaining members of the curling iron supports, and a reflecting device positioned behind the back surfaces of the curved curling iron supports for allowing a user to view the reflection of each of the temperature displays.

BACKGROUND OF THE INVENTION

Styling hair can often require the use of two or more curling irons in order to achieve the proper effect for a particular hair style. However, the use of more than one curling iron can pose a problem to a hair technician as the curling irons become hot with use and, therefore, cannot be laid down on a counter etc. when not needed. It would be a benefit, therefore, to have a curling iron organizer that allowed a number of curling irons to be simultaneously heated and provided a safe storage mechanism for holding the heated curling irons in a readily available location for use.

In addition, each curling iron must reach a predetermined temperature range before use of the curling iron is effective. It would be a benefit, therefore, to have a curling iron organizer that could simultaneously display the temperature of each of the curling irons being held at any given time. This would allow a hair technician to distinguish between a number of identical curling irons that have been set at different temperatures to achieve different curling effects.

SUMMARY OF THE INVENTION

It is thus an object of the invention to provide a curling iron organizer that includes a holding mechanism for a number of curling irons.

It is a further object of the invention to provide a curling iron organizer that includes a separate power outlet for each of a number of curling irons.

It is a still further object of the invention to provide a curling iron organizer that includes a temperature display for displaying the temperature of a curling iron.

It is a still further object of the invention to provide a curling iron organizer that accomplishes all or some of the above objects in combination.

Accordingly, a curling iron organizer is provided. The curling iron organizer comprises a housing having a plurality of curling iron holding cavities, each sized to receive the handle end of a curling iron at least partially therein; a power distribution circuit including a like plurality of power outlets; a like plurality of curling iron supports, each curling iron support including a tip receiving member constructed of a heat conducting material, such as metal, that is positioned with respect to one of said plurality of curling iron holding cavities in a manner such that the heated tip end of a curling iron is cradled within the tip receiving member when the handle of the curling iron is positioned within the respective curling iron holding cavity; a plurality of temperature display devices, at least one of said plurality of temperature display devices being mounted to a back surface of each of the tip receiving members; and a reflecting device attached to the housing and positioned with respect to the plurality of temperature display devices in a manner such that the reflection of each temperature display device can be viewed by a user.

Each of the curling iron holding cavities is preferably provided with a side and a top access pathway for allowing the handle portion of a curling iron to be inserted into the curling iron holding cavity from the top or from the side of the housing. In addition, each curling iron holding cavity is preferably provided with a groove for receiving the power cord of a curling iron to allow for easier insertion of the curling iron handle into the curling iron holding cavity.

It is also preferred to provide the power distribution circuit with an on/off switch for simultaneously disconnecting and connecting power to all of the outlets. When an on/off switch is provided, it is also desirable to have an indicator that illuminates when the on/off switch is in the "on" position. Use of an on/off switch allows a hair technician to turn off the curling irons when going to lunch or otherwise leaving the curling irons unattended.

Although the temperature display devices may take various forms, it is particularly desirable to use a chemical thermometer that simultaneously determines the temperature and provides a visual indication of the temperature of the tip of a curling iron by changing color. It is also desirable to include a second temperature display on each of the tip receiving members to provide additional reliability to the temperature output.

The reflecting device is preferably a conventional mirror. The reflecting device can also be angled with respect to the temperature display devices in order to enhance the visibility of each of the temperature display devices.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
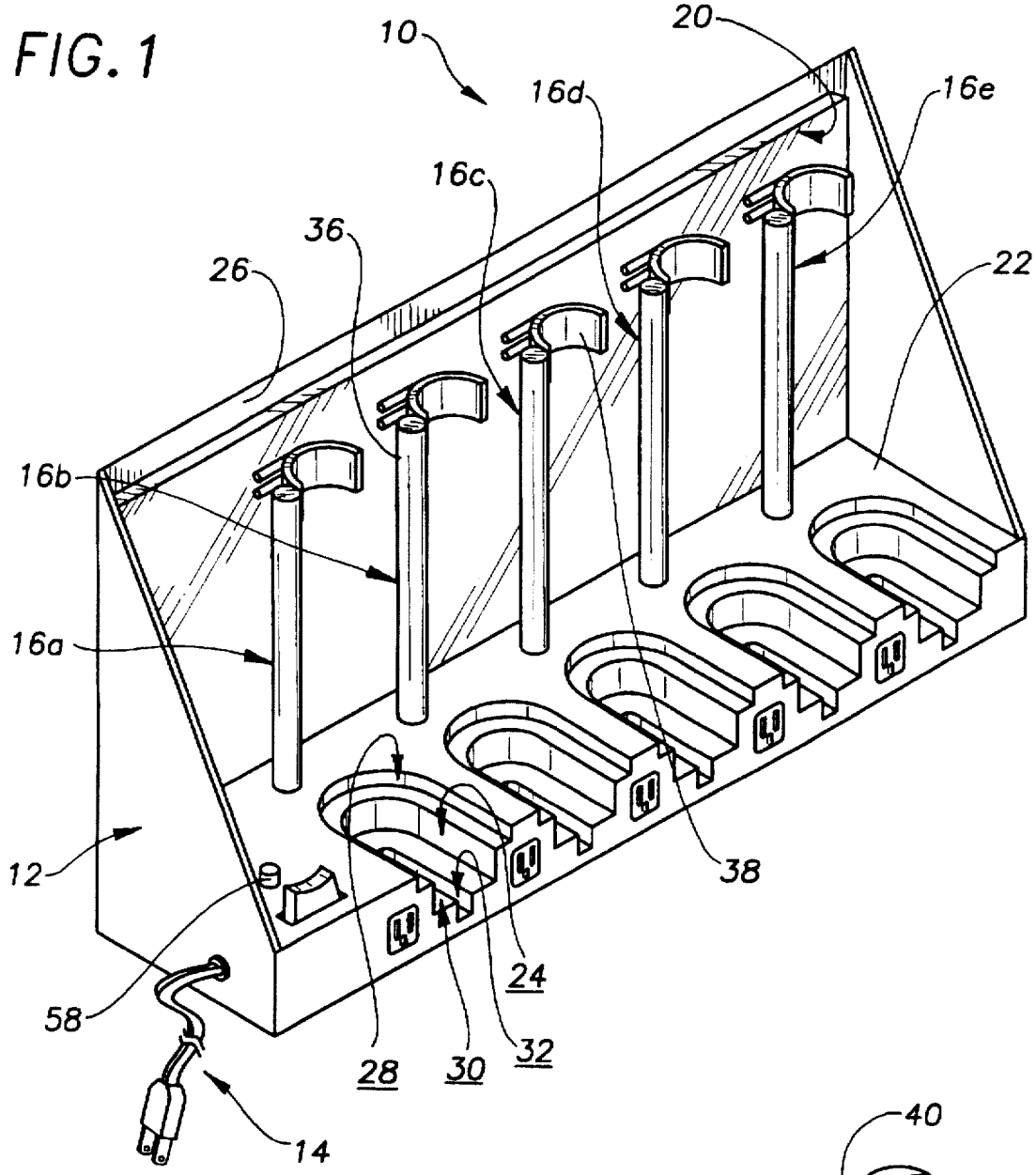
FIG. 1 is a perspective view of an exemplary curling iron organizer with temperature display of the current invention showing the housing, the back mirror, five curling iron holding cavities, five curved tip receiving members each with a pair of liquid crystal thermometers attached to the back thereof, the power on/off switch, and five power outlets.

FIG. 1 shows an exemplary embodiment of the curling iron organizer of the present invention generally designated by the numeral 10. Organizer 10 includes a housing, generally designated 12; a power distribution circuit, generally designated 14; five identical curling iron supports, generally designated by the numerals 16*a–e*; ten identical temperature display devices, generally designated 18 (FIG. 2); and a reflecting device, generally designated 20.

Housing 12 is constructed from molded plastic and includes a base portion 22, having five identical curling iron holding cavities 24 formed therein, and a back portion 26 extending upwardly from base portion 22. Each curling iron holding cavity 24 is provided with a top opening 28 and a side opening 30 in connection therewith to allow the handle of a curling iron to be at least partially inserted into curling iron holding cavity 24 downwardly through top opening 28 or laterally through side opening 30. Each curling iron holding cavity 24 is sized to receive the handle end of a curling iron at least partially therein. A power cord slot 32 is provided at the bottom of each curling iron holding cavity 24 to allow the power chord of a curling iron to be positioned therein while the handle of the curling iron is disposed within curling iron holding cavity 24.

Figure 2:
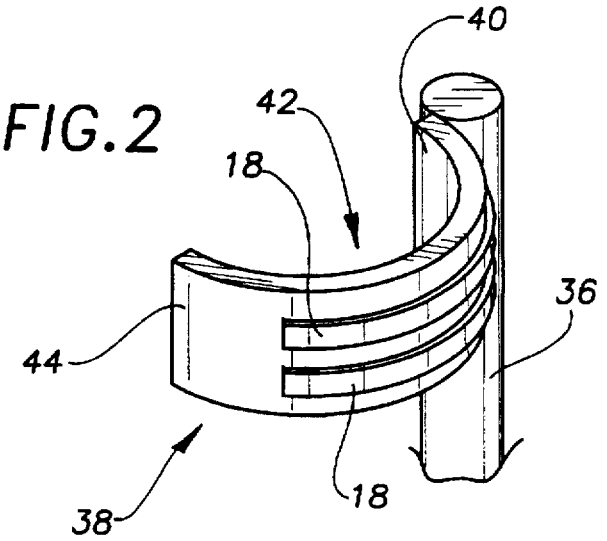
FIG. 2 is a detail perspective view of one of the five curved tip receiving members showing the pair of liquid crystal thermometers secured to the back surface thereof.

Each of the five identical curling iron supports 16*a–e* includes a vertically oriented, plastic support 36 and a metal tip receiving member 38. With reference to FIG. 2, tip receiving member 38 is adhesively secured to the end of plastic support 36 along one edge 40 thereof and is curved to provided a channel 42 into which the tip of a curling iron is positioned during use. The rearwardly facing surface 44 of each tip receiving member 38 is provided with two, conventional liquid crystal temperature strips 18 that change color according to the temperature of the temperature strip 18. With reference once again to FIG. 1, the reflection of each temperature strip 18 is visible in reflecting device 20.

In this embodiment, reflecting device 20 is a substantially rectangular section of conventional mirrored glass that has been adhesively secured to back portion 26 of housing 12. Reflecting device 20 is spaced a distance of about one-half inch away from tip receiving members 38.

Figure 3:
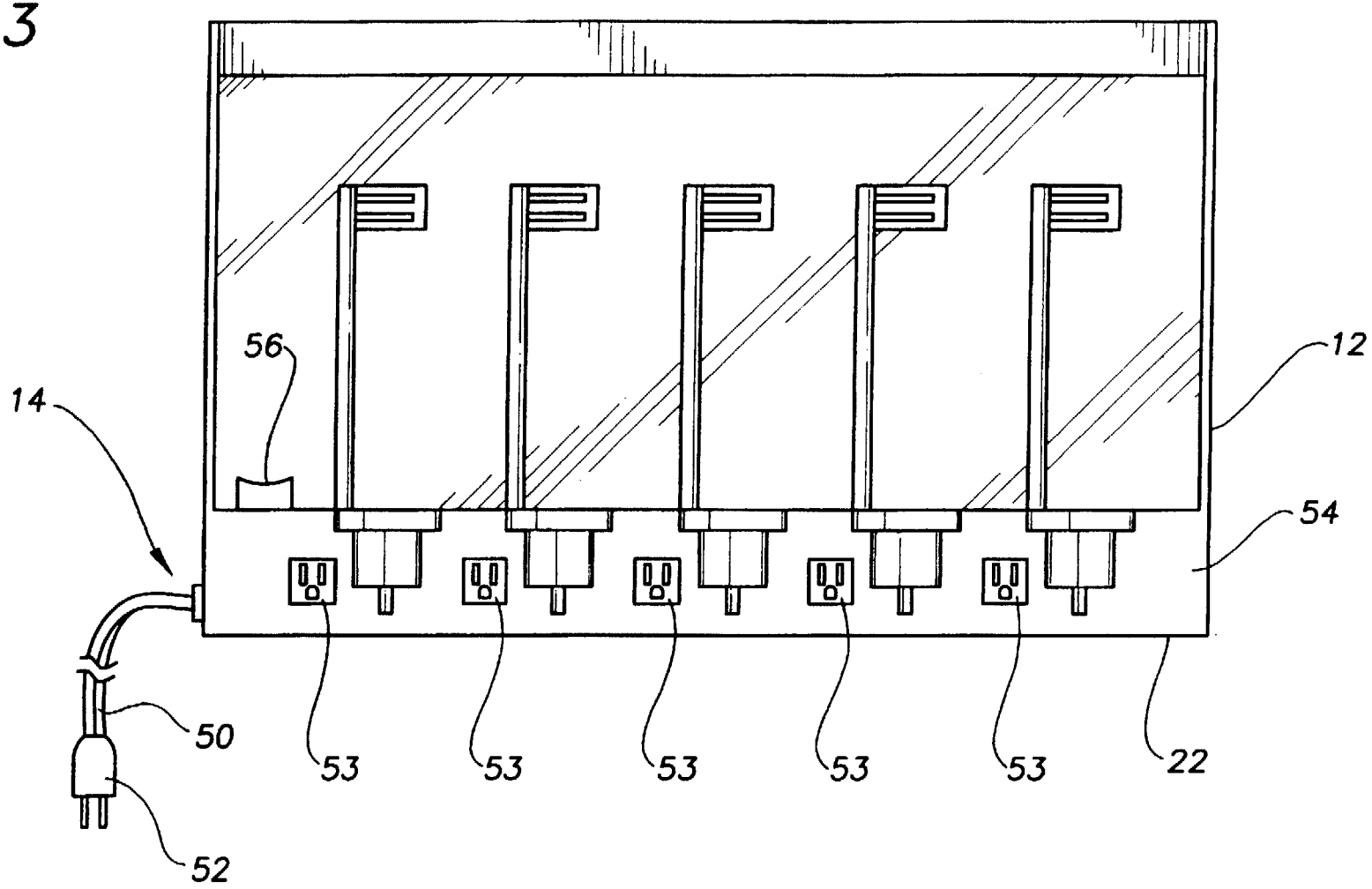
FIG. 3 is a front plan view of the curling iron organizer with temperature display of FIG. 1 showing the housing, the back mirror, the five curling iron holding cavities, the five curved tip receiving members, each with a pair of liquid crystal thermometers attached to the back thereof, the power on/off switch, and the five power outlets.

With reference to FIG. 3, power distribution circuit 14 includes a power cord 50 having a plug 52 connected at one end thereof, five conventional three-prong, 110 Volt power outlets 53 positioned along a forwardly facing surface 54 of base portion 22 of housing 12, an on/off switch 56, and a "power on" indicator light 58 (FIG. 1). On/off switch 56 connects electrical power to all five outlets 53 when in the "on" position and disconnects power from all five outlets 53 when in the "off" position.

Use of cord organizer 10 is now describe with general reference to FIGS. 1–3. Cord organizer 10 is installed for use by placing it on a counter or mounting back portion 26 to a wall or other vertical support surface with screws, nails or other conventional securing device. Once installed in the desired location, plug 52 is inserted into a conventional 110 Volt, wall power outlet and a desired number of curling irons (in this embodiment up to five) are plugged into an available outlet 53 and the handle thereof inserted into a respective curling iron receiving cavity 24 in a manner such that the heatable curling tip of the curling iron is cradled within the respective tip receiving member 38. As the tip of the curling iron warms, heat is conducted by metal tip receiving member 38 to temperature strips 18 increasing the temperature of temperature strips 18. As the temperature of each temperature strip 18 increases, the color of each temperature strip 18 changes to a color corresponding to the temperature achieved. Once temperature strip 18 for a particular curling iron achieves the required temperature/color, that curling iron is available for use. The curling irons can be easily and rapidly withdrawn from organizer 10 when needed and replaced when not needed in an organized and safe fashion.

It can be seen from the preceding description that a curling iron organizer has been provided that includes a holding mechanism for a number of curling irons; that includes a separate power outlet for each of the curling irons; and that includes a temperature display for displaying the temperature of each curling iron.

It is noted that the embodiment of the curling iron organizer described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A curling iron organizer comprising:

a housing having a plurality of curling iron holding cavities, each sized to receive a handle end of a curling iron at least partially therein;

a power distribution circuit including a plurality of power outlets accessible from an outer surface of said housing;

plurality of curling iron supports extending from said housing, each curling iron support including a tip receiving member constructed of a heat conducting material positioned with respect to one of said plurality of curling iron holding cavities in a manner such that said heated tip end of the curling iron is cradled within said tip receiving member when the handle end of said curling iron is positioned within said respective curling iron holding cavity;

a plurality of temperature display devices, at least one of said plurality of temperature display devices being mounted to a back surface of each of said tip receiving members; and a reflecting device attached to said housing and positioned with respect to said plurality of temperature display devices in a manner such that a reflection of each temperature display device can be viewed by a user.

2. The curling iron organizer of claim 1, wherein:

each of said plurality of curling iron holding cavities is provided with a side and a top access pathway.

3. The curling iron organizer of claim 2 wherein:

said temperature display device is a chemical thermometer that simultaneously determines a temperature and provides a visual indication of said temperature of said tip of a curling iron by changing color.

4. The curling iron organizer of claim 2 wherein:

each of said tip receiving members is provided with a second temperature display.

5. The curling iron organizer of claim 2 wherein:

said reflecting device is a mirror that is angled respect to said temperature display devices.

6. The curling iron organizer of claim 2 wherein:

each of said curling iron holding cavity is provided with a groove for receiving a power cord of a curling iron.

7. The curling iron organizer of claim 6 wherein:

each of said tip receiving members is provided with a second temperature display.

8. The curling iron organizer of claim 6 wherein:

said reflecting device is a mirror that is angled with respect to said temperature display devices.

9. The curling iron organizer of claim 6 wherein:

said temperature display device is a chemical thermometer that simultaneously determines a temperature and provides a visual indication of said temperature of said tip of a curling iron by changing color.

10. The curling iron organizer of claim 9 wherein:

each of said tip receiving members is provided with a second temperature display.

11. The curling iron organizer of claim 2 wherein:

said reflecting device is a mirror that is angled with respect to said temperature display devices.

12. The curling iron organizer of claim 1 wherein:

said reflecting device is a mirror that is angled with respect to said temperature display devices.

13. The curling iron organizer of claim 1, wherein:

each of said curling iron holding cavity is provided with a groove for receiving a power cord of a curling iron.

14. The curling iron organizer of claim 1 wherein:

said power distribution circuit includes an on/off switch for simultaneously disconnecting and connecting power to all of said outlets.

15. The curling iron organizer of claim 1 wherein:

said temperature display device is a chemical thermometer that simultaneously determines a temperature and provides a visual indication of said temperature of said tip of a curling iron by changing color.

16. The curling iron organizer of claim 15 wherein:

each of said tip receiving members is provided with a second temperature display.

17. The curling iron organizer of claim 16 wherein:

said reflecting device is a mirror that is angled with respect to said temperature display devices.

18. The curling iron organizer of claim 15 wherein:

said reflecting device is a mirror that is angled with respect to said temperature display devices.

19. The curling iron organizer of claim 1 wherein:

each of said tip receiving members is provided with a second temperature display.

20. The curling iron organizer of claim 1 wherein:

said reflecting device is a mirror that is angled with respect to said temperature display devices.

* * * * *